US005649863A

United States Patent [19]

Wada et al.

[11] Patent Number: 5,649,863

[45] Date of Patent: Jul. 22, 1997

[54] RUNNING MODEL FOR A RACE GAME MACHINE

[75] Inventors: Jingo Wada, Sagamihara; Isao Uehara, Zama, both of Japan

[73] Assignee: Konami Co., Ltd., Hyogo-ken, Japan

[21] Appl. No.: 604,517

[22] Filed: Feb. 21, 1996

[30] Foreign Application Priority Data

Feb. 21, 1995 [JP] Japan ..... 7-055228

[51] Int. Cl.[6] ..... A63H 13/04

[52] U.S. Cl. ..... 463/62; 446/286; 463/61

[58] Field of Search ..... 463/61, 62; 446/279, 446/280, 288, 290, 291, 292, 440, 448, 465, 466

[56] References Cited

U.S. PATENT DOCUMENTS 1,643,918 9/1927 Becker ..... 446/448 X
3,826,038 7/1974 Gentilini .

FOREIGN PATENT DOCUMENTS 1478711 5/1970 Germany .
1152698 10/1989 Japan .

*Primary Examiner*—William H. Grieb
*Attorney, Agent, or Firm*—Jordan and Hamburg

[57] ABSTRACT

A running model is used in a race game machine, and includes: a frame member; a front wheel rotatably supported at a front end of the frame; a rear wheel rotatably supported at a rear end of the frame; a dummy object mounted on the frame, the dummy object including a motion portion operatively connected with particular one of the front and rear wheels; and a support wheel rotatably supported on the frame, a lowest peripheral point of the support wheel being below a line connecting respective lowest peripheral points of the front and rear wheels.

12 Claims, 13 Drawing Sheets

RUNNING MODEL FOR A RACE GAME MACHINE

BACKGROUND OF THE INVENTION

This invention relates to a running model which is used in a race game machine, and has an imitation form of an animal and is movable in an imitation manner of the animal.

A running model of this type is disclosed, for example, in Japanese Unexamined Utility Model Publication No. 1-152698. In this publication, the running model is a model imitating a racing horse with a model horse racer riding thereon. A specified number of running model horses are used in a horse race game machine in which the ranking of the horses is predicted, and the prizes are bet. At a base of the running model are mounted drive wheels for driving the running model. The drive wheels are placed on a support plate for the game machine. As the running model runs on the support plate, the drive wheels roll on the support plate of the game machine. The rolling force of the drive wheels causes a crank member of the running model to reciprocatingly move. The reciprocating movement of the crank member is transmitted to front and rear legs of the model horse to thereby move the legs pivotally, and to thereby move the hip of the model horse racer upward and downward. In this way, an imitated motion of a racing horse and horse racer riding on the racing horse is produced.

Besides horse races, there are bicycle races. There has the demand of a race game machine resembling a bicycle race game. However, the above-mentioned running model has been worked to for horse race game machines. For bicycle race game machines, several points are required to be improved.

In the case of horse model, it is required to include a posture that the front or rear legs of the model horse are kept in a floated state in the air to represent a realistic motion. Accordingly, as shown in the Japanese publication, the front or rear legs of the model horse are supported on the support plate in a floated state, i.e., are not brought into contact with the support plate.

However, in the case of bicycle model, if the front or rear wheel of the model bicycle is supported on the support plate in a floated state similar to the case of horse model, the motion of such model bicycle is unnatural, which makes it difficult to imitate the motion of a bicycle in an actual bicycle race. This is because front and rear wheels of an actual bicycle are always kept in contact with a race track. On the other hand, in the case where both the front and rear wheels of the model bicycle are supported by the support plate in a contact state, the two wheels make the motion of the model bicycle unstable, and thus, it is necessary to additionally provide at least one (preferably two or more) wheel to stably support the model bicycle to the support plate in a contact state. However, the more the number of wheels in contact with the support plate, the larger an area with which the wheels are brought into contact, which increases the frictional resistance between the wheels and the support plate and consequently decelerate the moving speed of the running model.

In the case that running models are moved in their specified running courses by magnetic attraction, particularly, the increase in the frictional resistance between the support plate and the running model decreases the drawing force of magnetic attraction. Accordingly, it is preferable to reduce the frictional resistance as much as possible.

Further, in the case of bicycle race, a bicycle racer, especially the upper body, acts in sideways directions more distinctively than in vertical directions. However, the above-mentioned prior art cannot give such sideways actions to the model racer.

SUMMARY OF THE INVENTION

It is an object of the present invention to provide a running model for a race game machine which has overcome the problems residing in the prior art.

It is another object of the present invention to provide a running model for a race game machine which can realize a light movement.

It is another object of the present invention to provide a running model for a race game machine which can imitatingly reproduce the running motion of a bicycle racer.

A running model of the present invention comprises: a frame member having a front end and a rear end: a front wheel rotatably supported at the front end of the frame: a rear wheel rotatably supported at the rear end of the frame; a dummy object mounted on the frame, the dummy object including a motion portion operatively connected with particular one of the front and rear wheels; and a support wheel rotatably supported on the frame, a lowest peripheral point of the support wheel being below a line connecting respective lowest peripheral points of the front and rear wheels.

It may be preferable that the support wheel is disposed between the front and rear wheels, and the center of gravity of the running model is between the support wheel and the particular wheel.

The motion portion may be preferably constructed by: a crank mechanism operatively connected with the particular wheel to be actuated by a rotation of the particular wheel; a rotary member supported by the frame and rotatable about a forward and rearward direction, the rotary member being operatively connected with the crank mechanism; and an appearance part of the dummy object fixedly connected with the rotary member.

The crank mechanism may be provided with: a rotary shaft rotatably supported by the frame and extending in a sideways direction and having a right end and a left end; a right link member having an end operatively connected with a right side of the rotary member and another end fixedly connected with the right end of the rotary shaft; and a left link member having an end operatively connected with a left side of the rotary member and another end fixedly connected with the left end of the rotary shaft, the another end connection position of the left link member being shifted from that of the right link member 180 degree with respect to the rotation of the rotary shaft.

With this arrangement, when the running model is placed in a flat plane, the lowest peripheral point of the support wheel and the lowest peripheral point of one of the front and rear wheels are kept in contact with the flat plane, while the other wheel is supported on the flat plate in a floated state in the air. Accordingly, the frictional resistance between the running model and the flat plane can be remarkably reduced. Thus, lighter model movement can be attained.

Also, the support wheel is disposed between the front and rear wheels, and the center of gravity of the running model is located between the support wheel and the particular wheel. Accordingly, the support wheel and the particular wheel operatively connected with the motion portion of the dummy object are kept in contact with the flat plane. The other wheel is supported to the flat plane in a floated state in the air. This will assure the floating of one wheel among the three wheels, and the transmission of the torque of the particular wheel to the motion portion of the dummy object.

The rotary member carrying an appearance part of the dummy object is rotated by the crank mechanism. The crank mechanism is actuated by the particular wheel in contact with the flat plane. This will make it possible to give the dummy object a sideways motion by the use of a force produced during the running.

Further, there is provided the right and left link members. The respective movements of the right and left link members are shifted from each other 180 degrees. Accordingly, the rotary member can be alternately moved right and left. This will give an increased motion variation to the dummy object.

These and other objects, features and advantages of the present invention will become more apparent upon a reading of the following detailed description and accompanying drawings.

DETAILED DESCRIPTION OF THE PREFERRED EMBODIMENTS OF THE INVENTION

Hereafter, one embodiment of the invention is described in detail with reference to the accompanying drawings.

Figure 1:
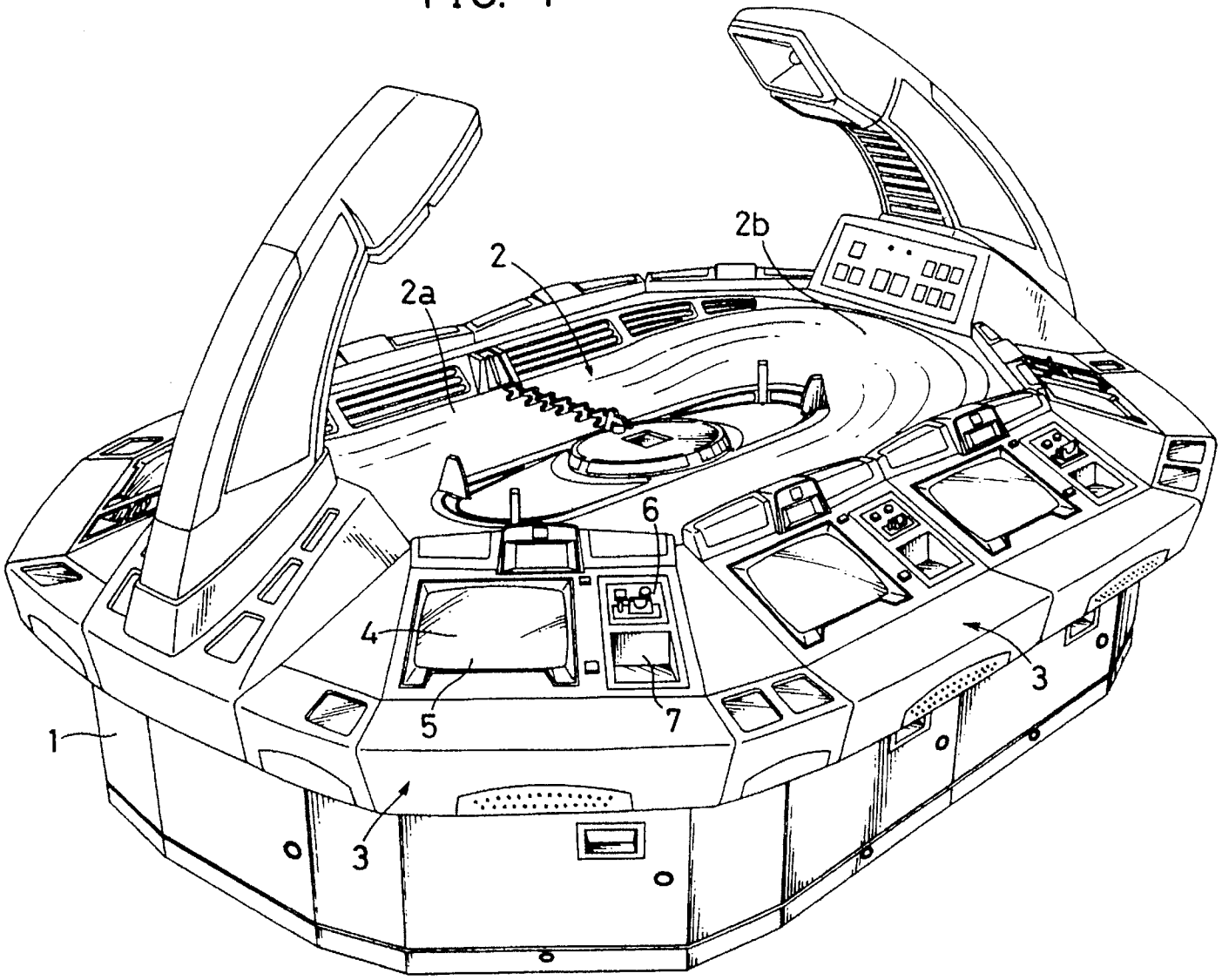
FIG. 1 is a perspective view showing an entire construction of a game machine as one embodiment of the invention.

FIG. 1 is a perspective view showing an entire construction of a game machine as one embodiment of the invention. In this embodiment, the invention is applied to a bicycle race game machine simulating a bicycle race (particularly, so-called "KEIRIN" race). In FIG. 1, indicated at 1 is a base, and at 2 a track formed on the base 1. The track 2 of this embodiment is of oval ring shape in which the opposite ends of two straight tracks 2*a* are connected by round tracks 2*b* of semicircular shape.

The round tracks 2*b* is formed to have a so-called bank shape which slopes obliquely upward as it expands from the inner circumference toward the outer circumference. More specifically, the outer circumference of the center portion of the round track 2*b* (a portion farthest from the straight tracks 2*a*) is highest, and the inner circumference of the center portion is at the same height as the straight tracks 2*a*. Connection portion of the round track 2*b* and the straight track 2*a* is also formed such that the outer circumference portion is slightly higher than the inner circumference portion. Such connection portions permit the track 2 to have a continuously curved surface.

Operation units (or control panels) 3 are provided around the base 1. The operation unit 3 is adapted to show specified displays to a player of this game machine and to enable the player to input necessary information. The number of the operation units is equal to the number of players who can play the game at the same time in this machine (8 players in this embodiment).

Each operation unit 3 includes a monitor 4, an operation panel 5 formed of a transparent touch panel provided on the surface of the monitor 4, a coin insertion slot 6 and a coin pay slot 7. On the monitor 4 are displayed information necessary for the game, such as a start of the game, introduction of participating bicycle racers, odds, and prize. The player is allowed to input a variety of information by means of the operation panel 5. For example, the player makes a bet by means of the operation panel 5.

In this embodiment, six models 80 are placed on the track 2. Each model has the form of a bicycle. The respective model bicycles are enabled to run on the track 2 by means of a drive mechanism to be described below.

Figure 2:
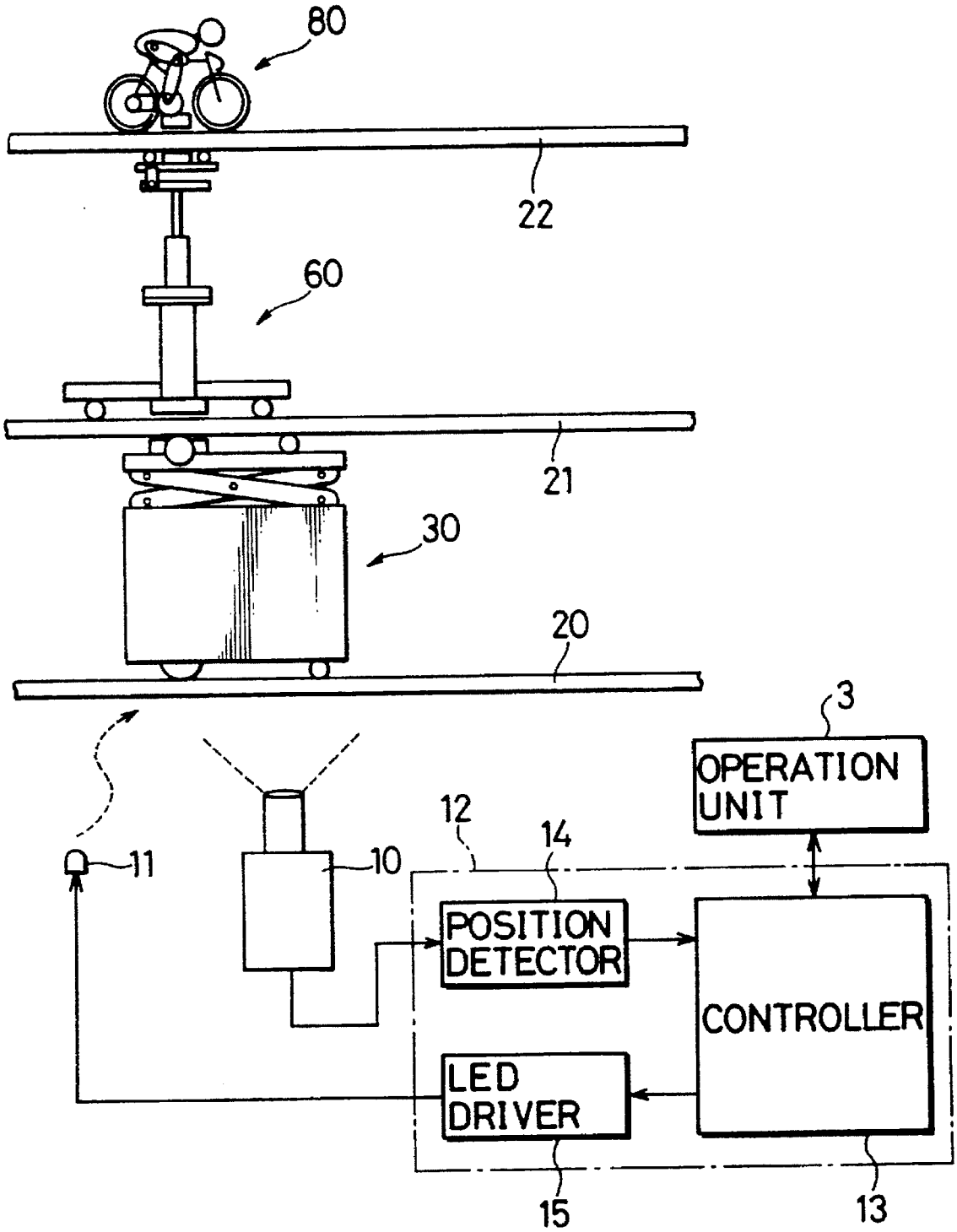
FIG. 2 is a diagram schematically showing a drive mechanism for driving a model in the form of a bicycle used in this embodiment.

FIG. 2 is a diagram schematically showing the drive mechanism for driving the model bicycle. As shown in FIG. 2, the base 1 of the game machine includes a support plate 20 of glass or like material which permits a light beam to pass therethrough, an intermediate support plate 21 disposed in parallel with and above the support plate 20, and a running plate 22 having an upper surface which forms the track 2. Thus, the base 1 has a three-storied structure. Running bodies 30 and intermediate vehicles 60 are disposed between the support plate 20 and the intermediate support plate 21, and between the intermediate support plate 21 and the running plate 22, respectively. The numbers of the running bodies 30 and the intermediate vehicles 60 are each equal to the number of the model bicycles. The model bicycles 80 are disposed on the upper surface of the running plate 22 (i.e., on the upper surface of the track 2).

Figure 3:
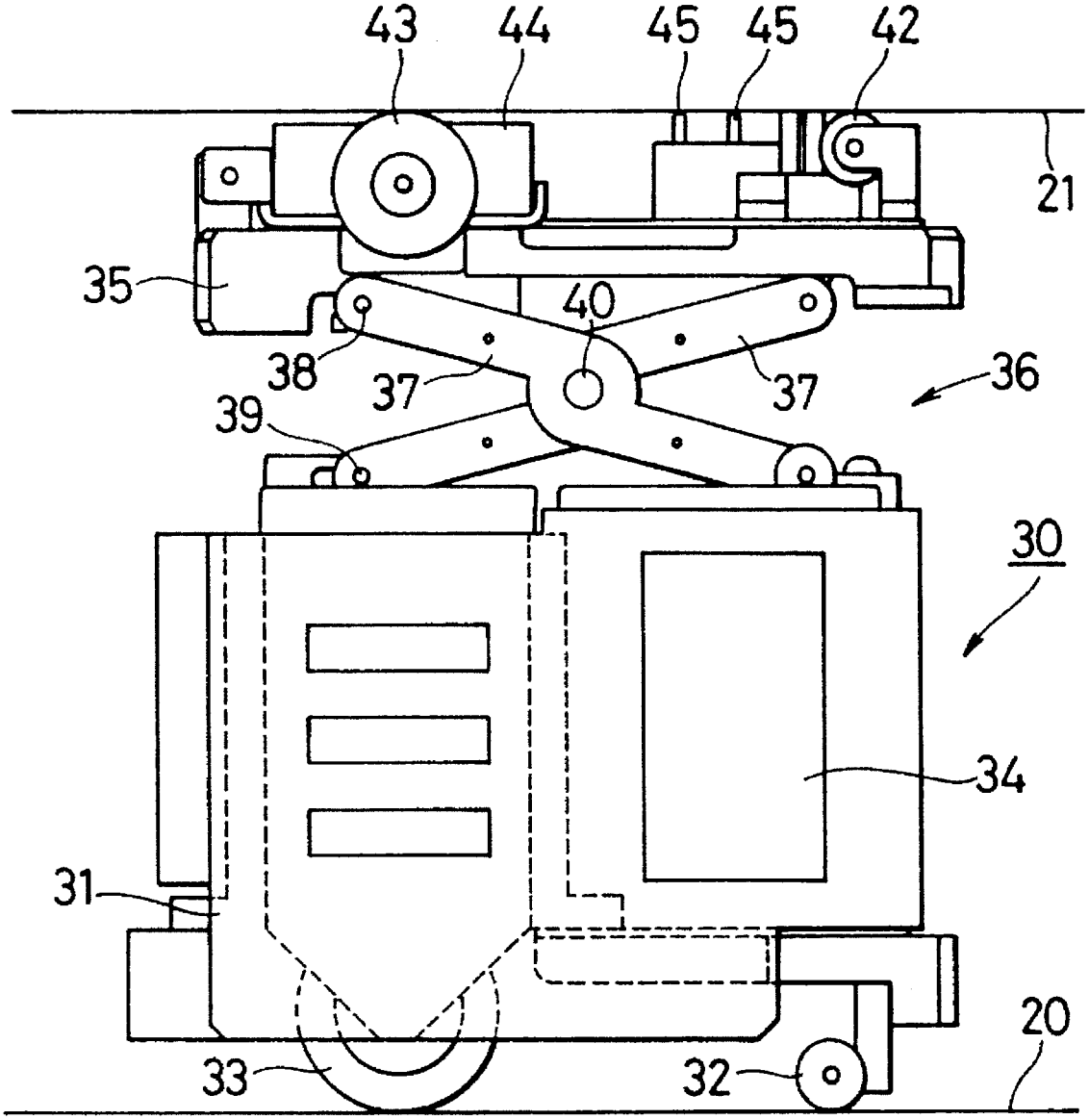
FIGS. 3 and 4 are front and right side views showing an external construction of a running body used in this embodiment, respectively.
Figure 4:
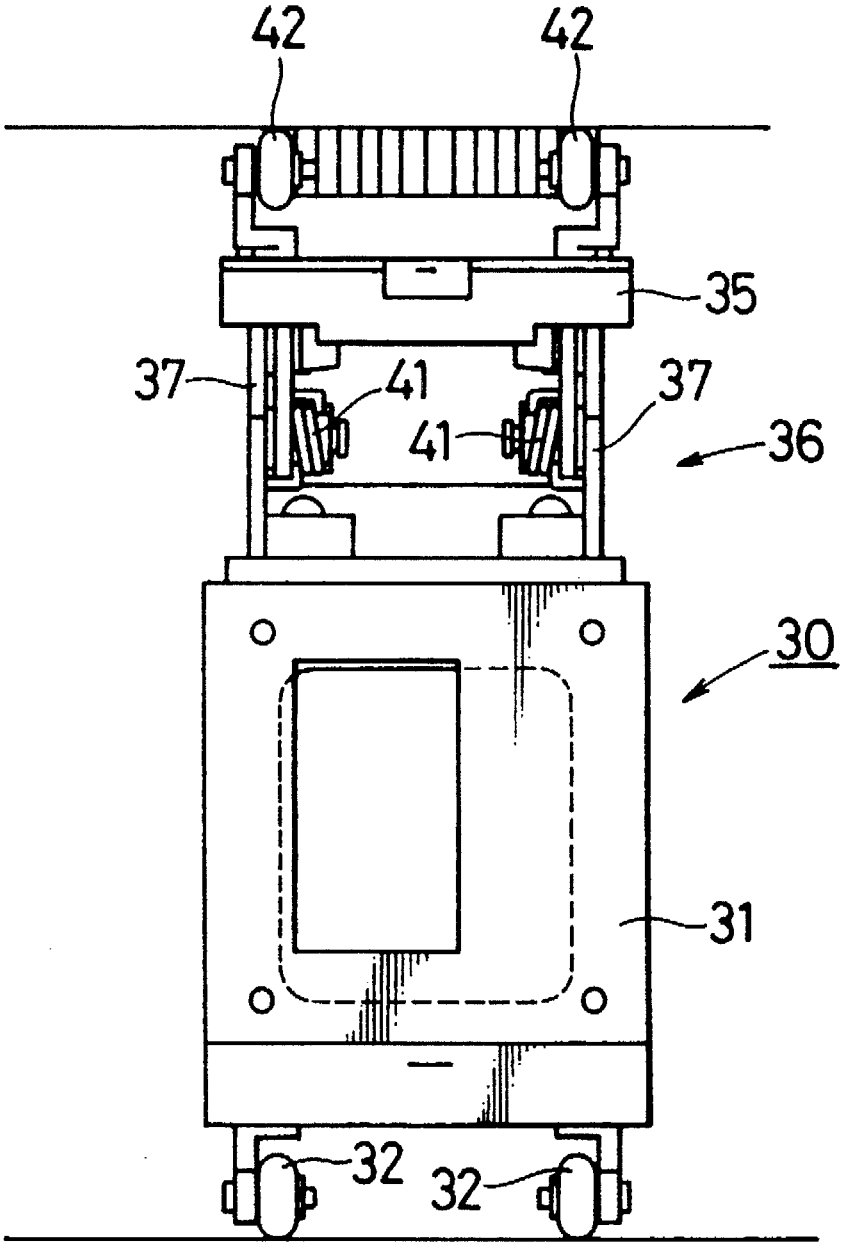

FIGS. 3 and 4 are front and right side views showing the external construction of the running body 30. In these FIGS., indicated at 31 is a hollow rectangular casing of the running body 30. Casters 32 and drive wheels 33 are rotatably mounted at a front bottom portion of the casing 31 (right side in FIG. 3) and at a rear bottom portion of the casing 31 (left side in FIG. 3) with respect to a moving direction of the casing 31. An unillustrated drive shaft of the drive wheels 33 are coupled with a motor unillustrated in FIGS. 3 and 4, and the drive wheels 33 are driven by this motor. Indicated at 34 is a circuitry board housed in the casing 31. A variety of circuits such as a microcomputer to be described later are formed on the base plate 34.

Indicated at 35 is an upper base located above the casing 31. The casing 31 and the upper base 35 are connected via an extensible pantograph mechanism 36 such that they move with respect to each other in the vertical direction. The pantograph mechanism 36 includes two each of link members 37 provided at the upper left and right ends of the casing 31. The opposite ends of each link member 37 are connected with the upper part of the casing 31 and the lower part of the upper base 35 via pins 39 and 38, respectively. The two link members 37 at the left and right sides are connected in their center via a pin 40, and are biased by a spring 41 in such a direction that a distance between the casing 31 and the upper base 35 becomes larger.

A pair of casters 42 and a pair of rollers 43 are rotatably mounted at a front portion of the upper base 35 and at the left and right sides of the upper base 35 with respect to a moving direction of the upper base 35, respectively. The upper ends of the casters 42 and the rollers 43 are at the same height. As shown in FIG. 2, when the running body 30 is disposed between the support plate 20 and the intermediate support plate 21, the upper ends of the casters 42 and the rollers 43 come into contact with the bottom surface of the intermediate support plate 21 and accordingly rotate as the running body 30 runs. A permanent magnet 44 is disposed between the rollers 43. The upper end of the permanent magnet 44 is set slightly lower than that of the rollers 43. Thus, when the rollers 43 are in contact with the bottom surface of the intermediate support plate 21, the permanent magnet 44 is spaced apart from this bottom surface by a very small distance.

Indicated at 45 are a plurality of collecting electrodes disposed at the front portion of the upper base 35 with respect to its moving direction. The collecting electrodes 45 project from the upper base 35, the collecting electrodes 45 are spaced apart from one another at specified intervals. The collecting electrodes 45 are made projectable and retractable in the vertical direction by an unillustrated mechanism, and are biased upward by unillustrated springs. The collecting electrodes 45 are connected with the respective circuits on the base plate 34 via lead wires and a stabilized power source (both not shown in FIGS. 3 and 4). On the other hand, positive and negative electrodes (not shown) for supplying a power are provided on the bottom surface of the intermediate support plate 21. A supply voltage is supplied to the respective electrodes from an external power source.

Accordingly, the upper ends of the collecting electrodes 45 come into contact with the electrodes of the intermediate support plate 21 when the running body 30 is disposed between the support plate 20 and the intermediate support plate 21. Since the upper ends of the collecting electrodes 45 are constantly in sliding contact with the electrodes of the intermediate support plate 21 even if the running body 30 runs on the support plate 20, the supply voltage from the external power source is supplied to the running body 30 via the collecting electrodes 45.

More specifically, a pair of diodes in opposite conductive directions are connected with the respective collecting electrodes 45. Output lines of the positive direction diode are combined and connected with a positive terminal of the stabilized power source, whereas output lines of the negative direction diode are combined and connected with a negative terminal of the stabilized power source. Accordingly, if at least one collecting electrode 45 is in contact with the positive and negative electrodes of the intermediate support plate 21, the supply voltage from the external power source is supplied to the stabilized power source, and its polarity is constantly fixed. Thus, the positive and negative electrodes and the collecting electrodes are disposed such that at least one collecting electrode 45 is in contact with the positive and negative electrodes of the intermediate support plate 21 regardless of in which position on the support plate 20 the running body 30 is running.

Figure 5:
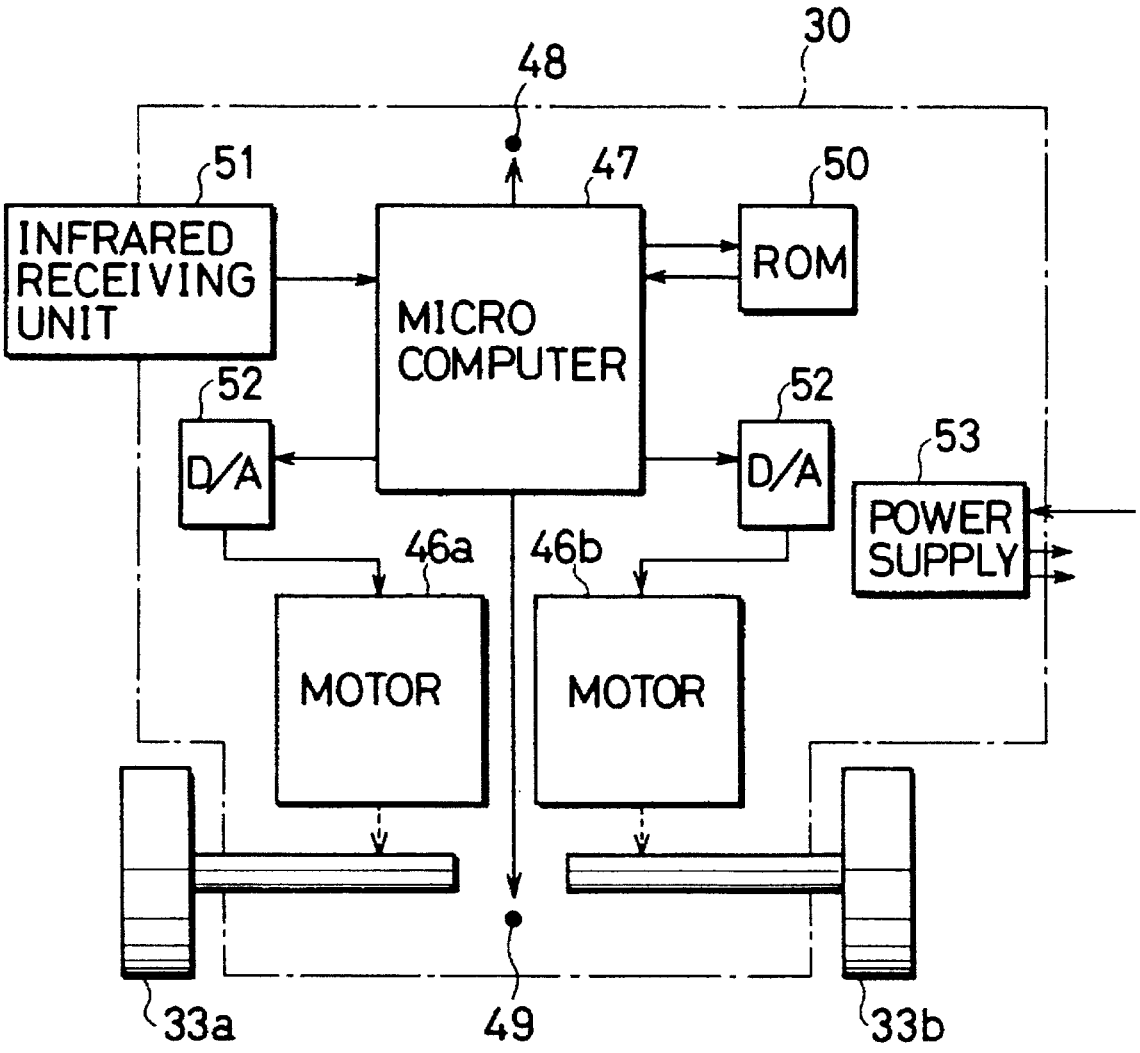
FIG. 5 is a block construction diagram of the running body when viewed from above.

FIG. 5 is a block construction diagram of the running body when viewed from above.

The running body 30 includes a pair of motors 46*a*, 46*b* for independently driving the pair of drive wheels 33*a*, 33*b* of resin or like material. In the description below, the drive wheels 33*a*, 33*b* and the motors 46*a*, 46*b* are indicated at 33, 46 respectively unless specified.

In this embodiment, DC motors are used as the motors 46 so that the speed of the running body 30 can be duty-controlled and the running body 30 can run backward (by inversion of polarity of a supply current) if necessary. Alternatively, pulse motors may be used so as to enable a speed control using a pulse frequency. Reduction gears are provided in a plurality of positions between a rotatable shaft of the motor 46 and that of the drive wheel 33 to ensure a specified speed range.

Indicated at 47 is a one-chip microcomputer as a controller of the running body 30. The microcomputer 47 analyzes a signal transmitted from a transmission LED 11 of a game machine main body 12 to generate a run control signal for the running body 30, and causes front and rear LEDs 48, 49 for emitting infrared rays. A ROM 50 is adapted to store an operation program of the microcomputer 47. Indicated at 52 is a digital-to-analog (D/A) converter for converting a digital signal used for a speed control which is output from the microcomputer 47 into an analog signal used to drive the motors 46.

The front and rear LEDs 48, 49 are disposed at a front center portion and at a rear center portion of the casing 31 (not shown in FIG. 5) of the running body 30 such that they are both directed right downward. A frequency band of the infrared rays emitted when the front and rear LEDs 48, 49 are turned on corresponds with a transmission frequency band of an infrared filter provided on the front surface of a CCD camera 10 to be described later. Only the infrared rays having a frequency within the transmission frequency band can pass through the infrared filter. The infrared rays passed through the infrared filter are sensed by the CCD camera 10 disposed below the support plate 20. The LEDs 48, 49 are fabricated such that the rays propagate over a wide angle. The rays can be sensed by the CCD camera 10 in any arbitrary position on the support plate 20.

Indicated at 51 is an infrared ray receiving unit which includes a photodiode or the like for receiving an optical pulse signal transmitted from the transmission LED 11. The unit 51 is so disposed as to face downward at the center bottom portion of the casing 31 of the running body 30. The unit 51 is, for example, exposed so as to receive the rays over a wide range. Indicated at 53 is a stabilized power supply circuit for generating, voltages from the supply voltage supplied from the external power source such as a voltage of 5 V necessary to operate the microcomputer 47 and a voltage of 6 V necessary to operate the motor.

Figure 6:
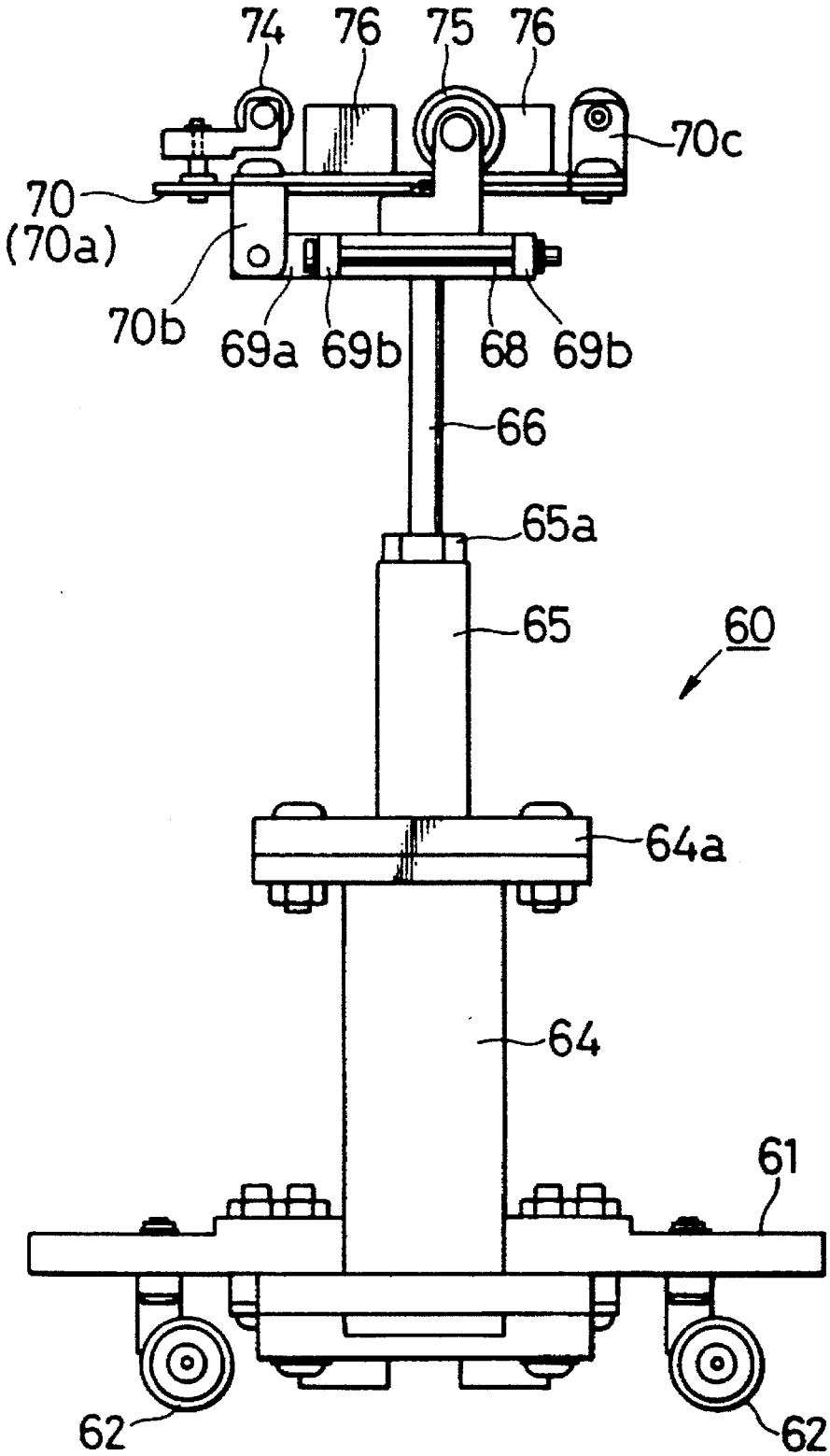
FIGS. 6, 7 and 8 are front, left side and plan views showing the external construction of an intermediate vehicle used in this embodiment, respectively.
Figure 7:
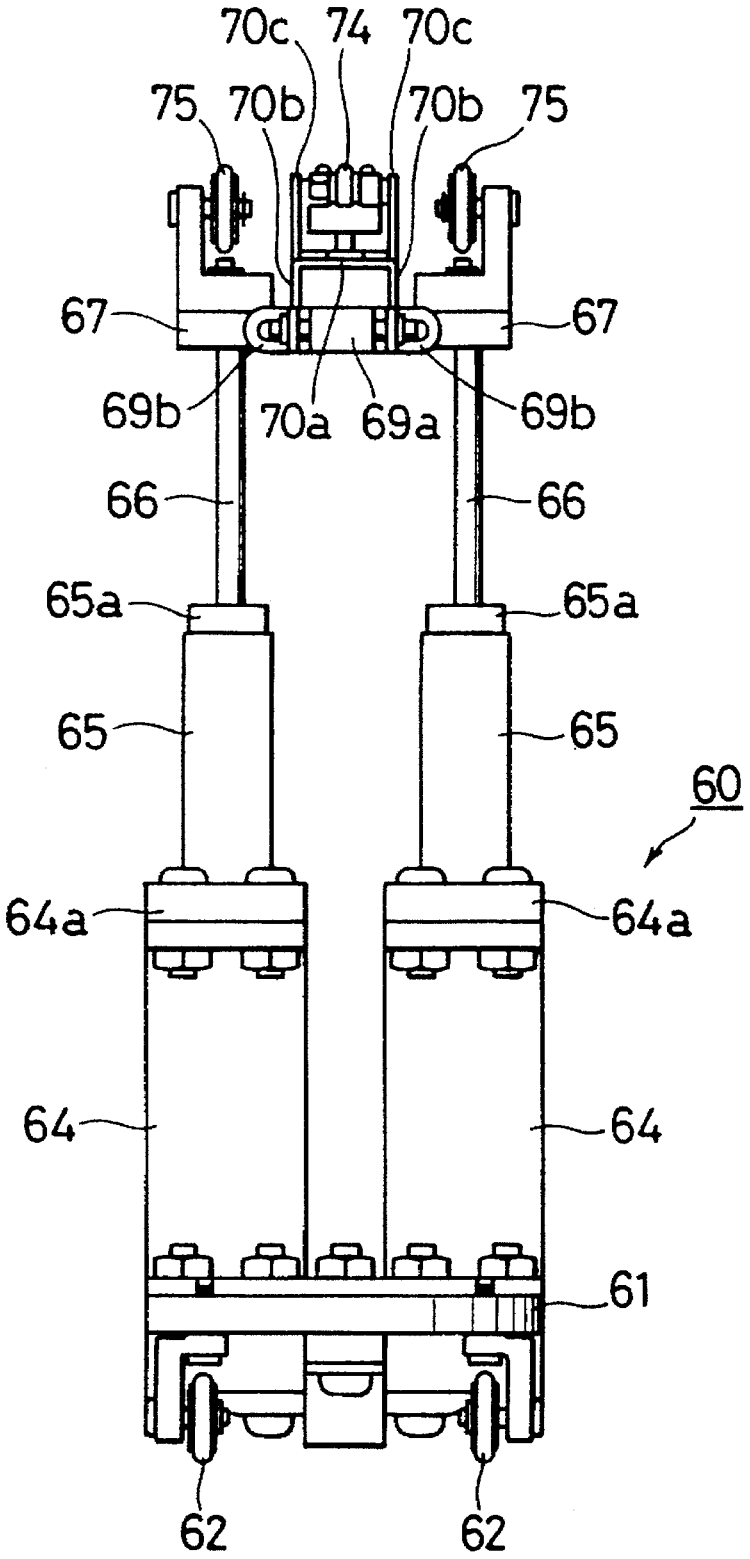
Figure 8:
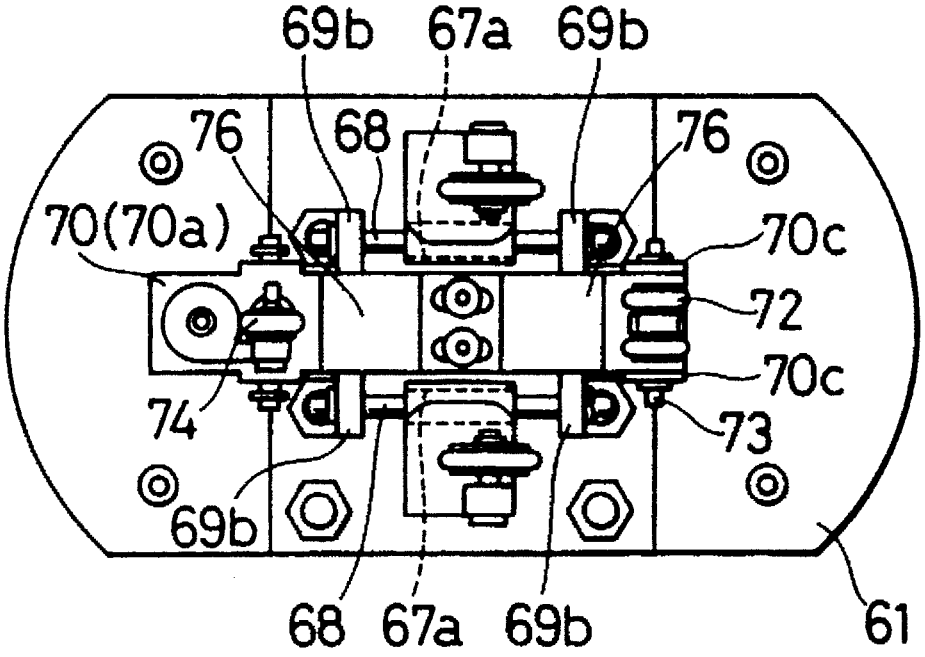

FIGS. 6, 7 and 8 are front, left side and plan views showing the external construction of an intermediate vehicle 60 used in this embodiment, respectively. In these FIGS., indicated at 61 is a plate-like base. A pair of casters 62 are mounted at the opposite lateral ends of each of the front (right side in FIG. 6) and rear (left side in FIG. 6) portions of the base 61 with respect to a moving direction of the base 61. In other words, four casters 62 are mounted. Indicated at 63 is a permanent magnet mounted on the bottom surface of the base 61. The lower end of the permanent magnet 63 is set slightly higher than the lower ends of the casters 62. Accordingly, when the intermediate vehicle 60 is placed on the intermediate support plate 21, the permanent magnet 63 is located above and spaced apart from the upper surface of the intermediate support plate 21 by a very small distance.

Large cylinders 64 having an open upper end and a closed bottom stand upright at the opposite lateral ends of the base 61. A small cylinder 65 having a diameter smaller than that of the large diameter 64 is accommodated in each large cylinder 64. Similar to the large cylinders 64, the small cylinders 65 each have an open upper end and a closed bottom. An unillustrated spring is disposed between the bottom of the small cylinder 65 and that of the large cylinder 64. A piston rod 66 is accommodated in each small cylinder 65. An unillustrated spring is also disposed between the bottom of the piston rod 66 and that of the small cylinder 65.

Accordingly, the small cylinder 65 and the piston rod 66 are constantly biased upward. At the upper end of the large cylinder 64 is mounted a pressing member 64*a* for preventing the small cylinder 65 from coming out of the large cylinder 64. Further, at the upper end of the small cylinder 65 is mounted a nut 65*a* for preventing the piston rod 66 from coming out of the small cylinder 65.

A bracket 67 is secured on the upper end of each piston rod 66. In each bracket 67 is formed a through hole 67*a* which horizontally extends along a moving direction (lateral direction of FIG. 8) of the intermediate vehicle 60 as best shown in FIG. 8. The through holes 67*a* are formed on inner portions of the corresponding brackets 67. A rotatable rod 68 is inserted through each through hole 67*a*. The opposite ends of the rotatable rod 68 are rotatably connected with coupling plates 69. The coupling plate 69 includes a rectangular plate-like main body 69*a* and flanges 69*b* projecting in the lateral directions from the front and rear ends of the main body 69*a*. The flanges 69*b* are each formed with an unillustrated through hole through which the rotatable rods 68 are inserted.

A pivotal member 70 is pivotally mounted at the rear end (left end in FIG. 6) of the coupling plate 69. The pivotal member 70 includes a narrow plate-like base portion 70*a*, a pair of pivotal mount portions 70*b* extending downward from the opposite ends of the rear end (left end in FIG. 6) of the base portion 70*a*, and a pair of plate-like roller mount portions 70*c* extending upward from the opposite ends of the front end (right end in FIG. 6) of the base portion 70*a*.

An unillustrated through hole is formed to horizontally extend at the rear end of the coupling plate 69. A through hole is also formed in the pivotal mount portion 70*b* of the pivotal member 70. By inserting and fixing a pin 71 in the through holes of the coupling plate 69 and the pivotal mount portion 70*b*, the pivotal member 70 is pivotally mounted with respect to the coupling plate 69. An unillustrated spring is disposed between the coupling plate 69 and the pivotal member 70. This spring constantly biases the pivotal member 70 upward.

On the other hand, a through hole is formed in the roller mount portion 70*c* of the pivotal member 70. By inserting a rotatable shaft 73 of a roller 72 through this through hole, the roller 72 is rotatably mounted with respect to the pivotal member 70. Indicated at 74 is a caster mounted at the rear end of the base portion 70*a* of the pivotal member 70. Similarly, a caster 75 is mounted above the bracket 67. The rollers 72 and the casters 74, 75 are set such that their upper ends are at the same height in an extended state of the two smaller cylinders 65 and the two piston rods Indicated at 76 is a permanent magnet mounted on the upper surface of the base portion 70*a* of the pivotal member 70. The upper end of the permanent magnet 76 is set slightly lower than the upper ends of the rollers 72 and the casters 74, 75. Accordingly, when the intermediate vehicle 60 is disposed between the intermediate support plate 21 and the running plate 22, the permanent magnet 76 is located below and spaced apart from the lower surface of the running plate 22 by a very small distance.

In the above construction, even if the distance between the intermediate support plate 21 and the running plate 22 changes, the small cylinders 65 and the piston rods 66 suitably extend and contract, with the result that the roller 72 and the casters 74, 75 are constantly in contact with the lower surface of the running plate 22 and roll along the lower surface of the running plate 22 as the intermediate vehicle moves. In addition, even if the running plate 22 tilts along the moving direction (lateral direction in FIG. 6) of the intermediate vehicle 60, the pivotal plates 70 pivot with respect to the coupling plates 69 and thereby the rollers 72 and the casters 74 pivot along the moving direction. As a result, the rollers 72 and the casters 74 constantly remain in contact with the lower surface of the running plate 22.

Further, even if the running plate 22 tilts along a direction (lateral direction in FIG. 7) normal to the moving direction of the intermediate vehicle 60, the pairs of small cylinders 65 and piston rods 66 extend and contract independently of each other, with the result that the casters constantly remain in contact with the lower surface of the running plate 22. Thus, even if the running plate 22 has a three-dimensionally curved surface, the rollers 72 and the casters 74, 75 are constantly in contact with the bottom surface of the running plate 22 as long as the curved surface is continuous, i.e. can follow the height change of the curved surface.

The length and the extension/contraction stroke of the large cylinders 64, the small cylinders 65 and the piston rods 66 are so set as to sufficiently respond to a distance change between the intermediate support plate 21 and the running plate 22. In this embodiment, when the model bicycle 80 to be described later is located on the linear track 2*a* (i.e. when the distance between the intermediate support plate 21 and the running plate 22 are shortest), the small cylinders 65 and the piston rods 66 contract to their positions closer to their most contracted positions. On the other hand, when the model bicycle 80 is located at the outer circumference of the center portion of the round track 2*b* (i.e. when the distance between the intermediate support plate 21 and the running plate 22 is longest), the small cylinders 65 and the piston rods 66 extend to their positions closer to their most extended positions.

Figure 13:
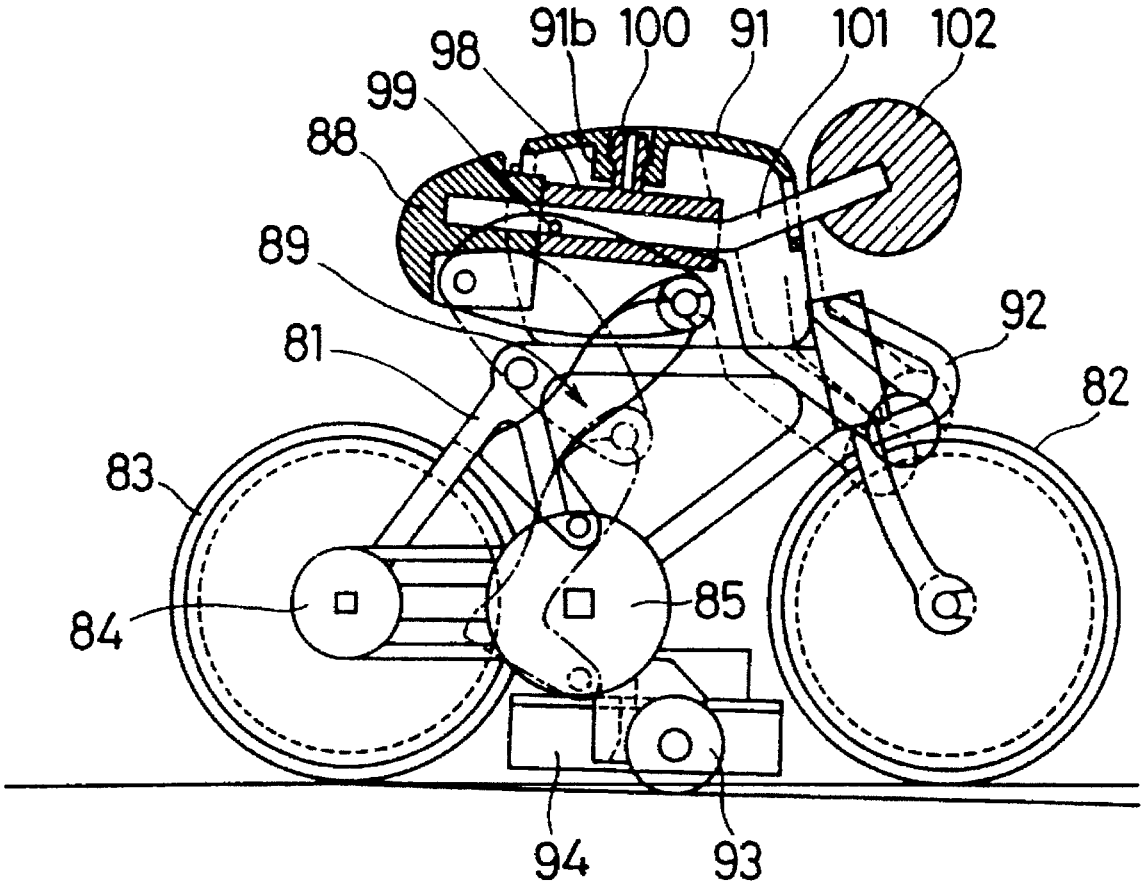
FIG. 13 is a cross sectional view partially showing an internal mechanism of the model bicycle.

FIGS. 9, 10, 11 and 12 are front, left side, right side and plan views showing the external construction of the model bicycle, respectively. FIG. 13 is a cross sectional view partially showing an internal mechanism of the model bicycle 80.

In these FIGS., indicated at 81 is a main frame of the model bicycle 80, by 82 a front wheel, and by 83 a rear wheel. The wheels 82 and 83 are both rotatably mounted on the main frame 81. Indicated at 84 is a drive pulley which is so secured on a rotatable shaft of the rear wheel 83 as to rotate together with the rear wheel 83. Indicated at 85 is a crank pulley which is rotatably mounted on the main frame 81. A drive force of the drive pulley 84 is transmitted to the crank pulley 85 via a rubber belt 86, with the result that, as the rear wheel 83 rotates, the crank pulley 85 rotates in the same direction.

Figure 9:
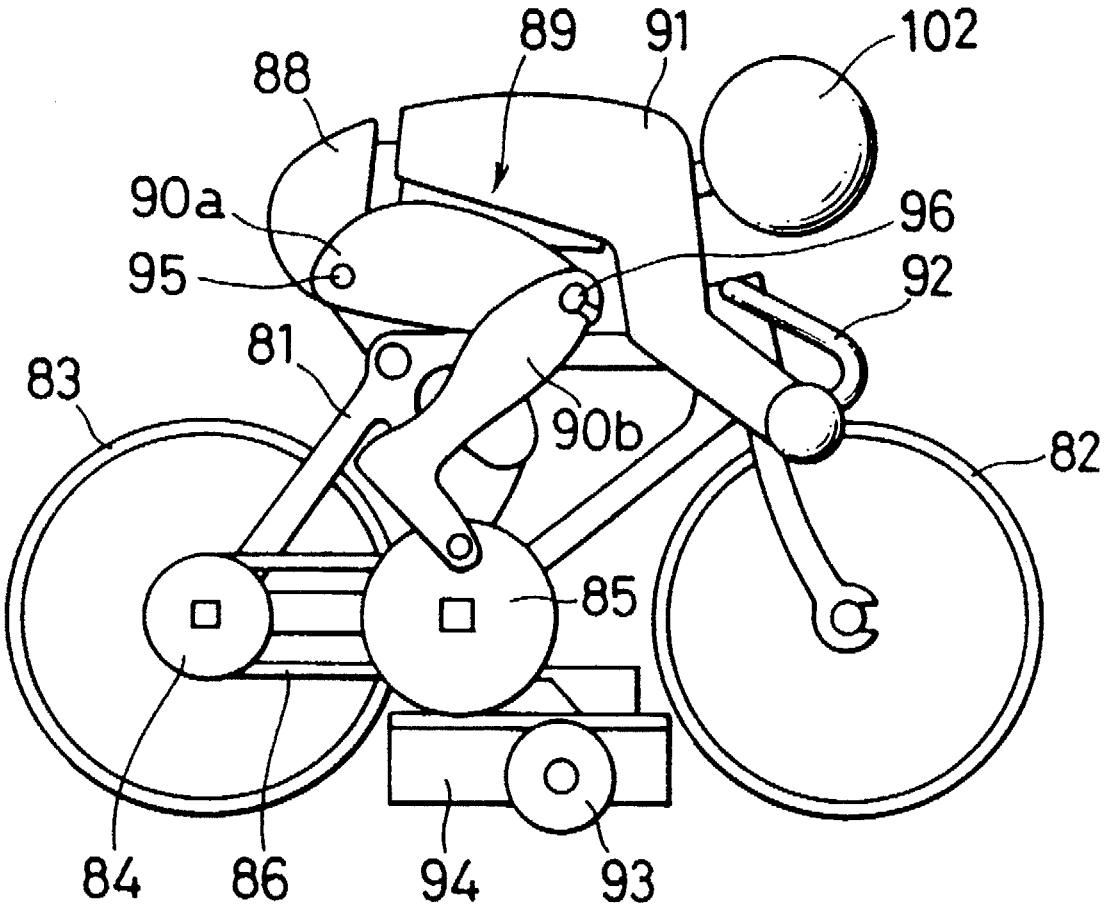
FIGS. 9, 10, 11 and 12 are front, left side, right side and plan views showing the external construction of the model bicycle, respectively.

Though unillustrated in FIG. 9, a crank pedal 87 is rotatably mounted on the main frame 81 on the side opposite from the crank pulley 85. Being secured on a rotatable shaft of the crank pulley 85, the crank pedal 87 rotates together with the crank pulley 85.

Indicated at 88 is a model racer main body secured to an upper portion of the main frame 81. Leg units 89 are provided at the left and right sides of the model racer main body 88. Each leg unit 89 includes two link members 90*a*, 90*b* which are connected with each other via a pin 96. Also, the link members 90*a* are connected with the model racer main body 88 by pins 95. The link members 90*b* are connected with the crank pulley 85 and the crank pedal 87 via pins 97*b*, 97*a*, respectively. More specifically, the pin 97*a* for coupling the link member 90*b* and the crank pulley 85 is mounted at a peripheral position of the crank pulley 85. Accordingly, the leg units 89 expands and contracts as the crank pulley 85 rotates. In other words, the model racer moves as if an actual bicycle racer were riding a bicycle.

Figure 10:
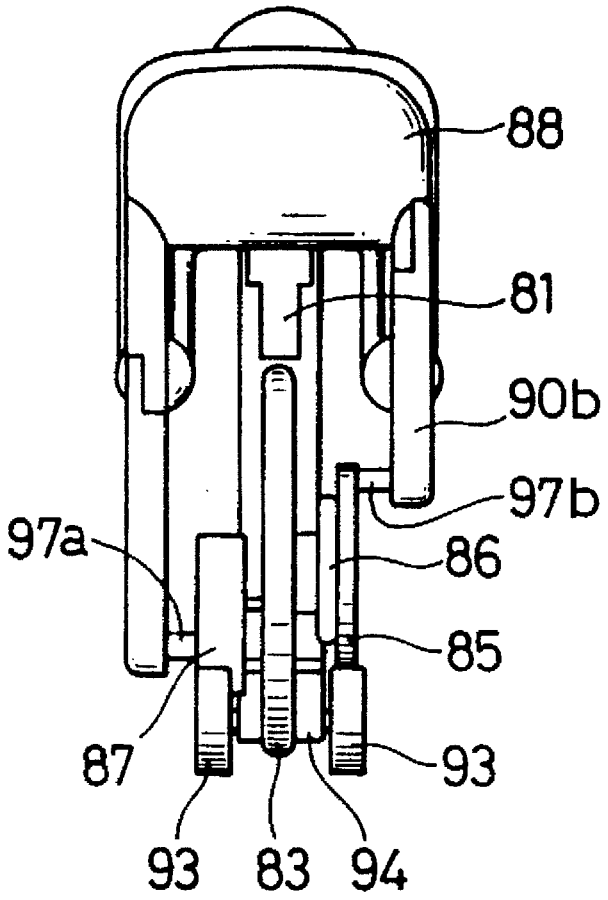
Figure 11:
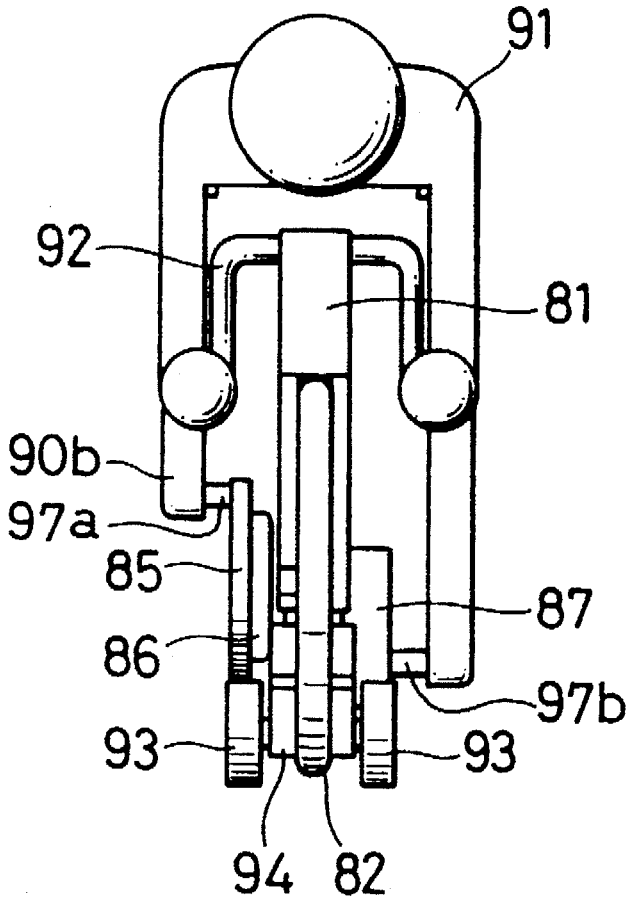
Figure 12:
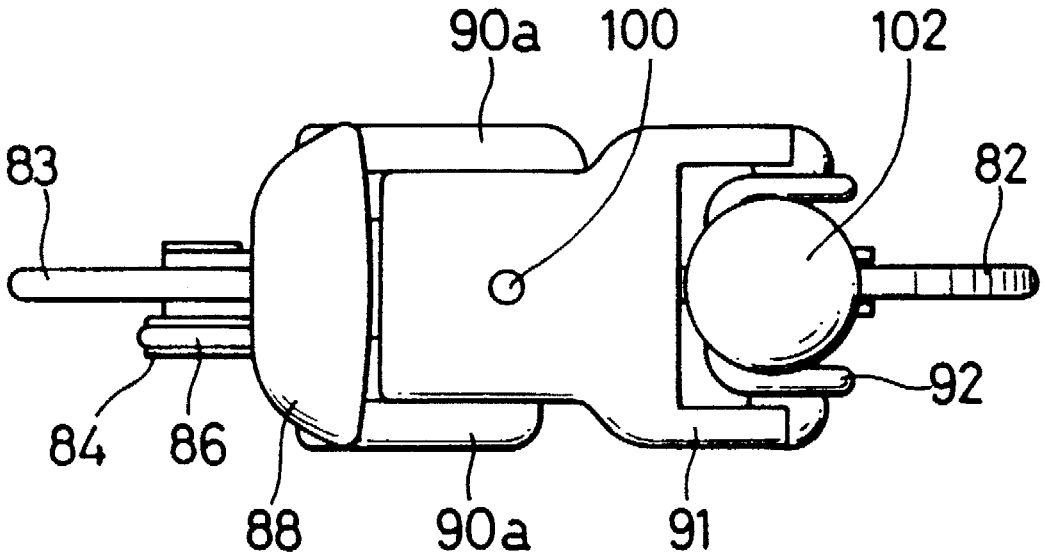

As shown in FIGS. 10 and 11, the pin 97*a* is attached to the crank pulley 85 and the pin 97*b* is attached to the crank pedal 87. The pin 97*a* and the pin 97*b* are out of phase 180 degrees. Accordingly, the right and left leg units 89 expand and contract alternately. This motion resembles a motion of an actual bicycle racer riding a bicycle.

As shown in FIG. 13, a shaft member 101 is fixedly secured to the front portion of the model racer main body 88. The shaft member 101 extends in the running direction of the model bicycle 80. A head unit 102 is fixedly secured to a lead end of the shaft member 101. A rotary cylinder 98 is rotatably mounted around the shaft member 101. The rotary cylinder 98 is rotatably about the shaft member 101. As shown in FIG. 13, the rotary cylinder 98 is inclined downward as extending forward (rightward in FIG. 13).

On right and left outside portions of the rotary cylinder 98 are respectively formed pins 99 extending outward. The right (left) pin 99 is engaged in a groove formed in an upper portion of the right (left) link member 90*a*. In other words, the pin 99 serves as a cam follower following a cam groove formed in the upper portion of the link member 90*a*. With this construction, as the leg units 89 expands or contracts, the pin 99 moves up and down. Specifically, as the upper link member 90*a* of the leg unit 89 moves, the pin moves along the groove formed in the link member 99, thereby rotating the rotary cylinder 98 about the shaft member 101. The leg units 89 alternately expand and contract. Accordingly, the right and left pins 99 also alternately move upward and downward, thereby causing the rotary cylinder 98 to rotate rightward and leftward about the shaft member 101.

Indicated at 100 is a connecting rod fixedly attached at an intermediate position of the rotary cylinder 98 between the right and left pins 99. Indicated at 91 is an upper body unit of the model racer. The upper body unit 91 includes arm units 91*a* on right and left sides thereof. Arm units 91*a* are fixedly secured to both ends of a handle unit 92 mounted at a front end of the main frame 81 movably upward and downward. Further, the upper body unit 91 is fixedly attached with a hollow cylinder 91*b* on an inner surface thereof. The connecting rod 100 fixedly attached on the rotary cylinder 98 is loosely placed in the hollow cylinder 91*b*.

In this way, the upper body unit 91 is supported by the connecting rod 100 and both ends of the handle unit 92. The connecting rod 100 moves right or left together with a rotation of the rotary cylinder 98. Accordingly, as the leg units 89 expand or contract, the upper body unit 91 swings as shown by the dotted lines in FIG. 13. Particularly, since the rotary cylinder 98 is inclined downnward as extending toward the front end of the upper body unit 91 in this embodiment, the upper body unit 91 is feasibly swung. It should be noted that the swinging amount of the upper body unit 91 is generally determined by a movable range of the handle unit 92.

Indicated at 93 are a pair of support rollers rotatably mounted on the lower portion of the main frame 81. The lower ends of the support rollers 93 are set lower than a line connecting the lower ends of the front and rear wheels 82 and 83 as shown in FIGS. 10, 11 and 13. In this embodiment, the center of gravity of the model bicycle 80 is positioned rear from the rotatable shaft of the support rollers 93 (left in FIG. 13). Accordingly, when the model bicycle 80 is placed on the running plate 22 (track 2), it is supported by the rear wheel 83 and the pair of support rollers 93, and the front wheel 82 is supported slightly above the running plate 22. It should be noted that the clearance between the front wheel 82 and the upper surface of the running plate 22 is so small that the players hardly notice that the front wheel 82 is supported slightly above the running plate 22.

Indicated at 94 is a permanent magnet mounted on the lower portion of the main frame 81. The lower end of the permanent magnet 94 is set slightly higher than the lower ends of the rear wheel 83 and the support rollers 93. Accordingly, when the model bicycle 80 is placed on the upper surface of the running plate 22, the permanent magnet is located above and spaced apart from the upper surface of the running plate 22 by a very small distance.

The running body 30, intermediate vehicle 60 and model bicycle 80 described above are disposed such that the permanent magnets 44, 63 and the permanent magnets 76, 94 face each other with the intermediate support plate 21 and the running plate 22 therebetween, respectively. Accordingly, the running body 30, the intermediate vehicle 60 and model bicycle 80 are pulled toward each other by the attraction of the permanent magnets 44, 63, 76 and 94. Thus, as the running body 30 runs, the intermediate vehicle 60 runs on the intermediate support plate 21 and the model bicycle 80 runs on the running plate 22.

Referring back to FIG. 2, indicated at 10 is the CCD camera as an area sensor, by 11 the transmission LED as a transmission means, and by 12 the game machine main body. The main body 12 is provided with a controller 13, a position detector 14 disposed between the CCD camera 10 and the controller 13, and a LED driver 15 disposed between the controller 13 and the transmission LED 11.

The controller 13 centrally controls an entire operation of the game machine according to this embodiment. The controller 13 includes a built-in computer (microcomputer), a ROM in which a game program and other programs are stored in advance, and a RAM for temporarily storing a position detection data from the position detector 14 and data being processed and storing necessary parameters.

In the case that there is provided one CCD camera 10, it is disposed substantially in the middle of the base 1 and at a specified height below the support plate 20 such that its sensing surface faces upward and the substantially entire lower surface of the base 1 falls within its view frame. Accordingly, the support plate 20 is a plate member of glass or like transparent material. The running body 30 is sensed by the CCD camera 10 through the support plate 20. In consideration of the view frame of the CCD camera 10, the support plate 20 preferably has a square or circular shape. However, in this embodiment, the shape of the support plate 20 conforms to the shape of the track 2.

As already known, the CCD camera 10 is such that a plethora of photodetectors which are solid-state photoelectric conversion elements are arranged in a matrix. For example, if the scanning cycle of the CCD camera 10 is selectable between 1/60 sec. per field and 1/30 sec. per frame, an image is picked up using 1 field as a scanning cycle. The CCD camera 10 outputs an electrical (image) signal having a converted level corresponding to an amount of rays received by the respective photodetectors.

An infrared transmission filter is disposed on a light receiving surface of the CCD camera 10 adopted in this embodiment so that the CCD camera receives only the infrared rays within a specified frequency band. In this way, an erroneous operation caused by external light is prevented. In place of the single CCD camera 10, a plurality of CCD cameras may be used. In such a case, the lower surface of the support plate 20 is divided into a plurality of areas, and images of the respective areas are picked up by the respective CCD cameras. With this arrangement, an image resolving power, i.e. a position detection accuracy can be improved.

The position detector 14 includes a frame memory in which the image signal from the CCD camera 10 is written, and an image processor for reading the content of the frame memory, detecting the position of the running body 30, and outputting coordinates representative of the detected position in the form of a detection signal. In this embodiment, the detection is performed in real time, more accurately, repeatedly at intervals of a very short period. Accordingly, in order to perform the image signal writing operation and the image signal reading operation in a parallel manner, there are provided two frame memories each having a storage capacity of 1 frame. The write only frame memory and the read only frame memory are switched in accordance with a switch signal from the image processor.

A technique for detecting the position of the running body 30 which is adopted by the image processor may be suitably selected from known image processing techniques. Since two LEDs 48, 49 are loaded in the running body 30 in this embodiment, an exemplary technique may be such that a suitable threshold value is set for the signal level of the image signal to convert the image into a binary data, and the position of a luminescent spot in the image is detected by means of pattern matching, labeling or the like.

The transmission LED 11 is a light emitting element for emitting, e.g. infrared rays. Similar to the CCD camera 10, the transmission LED 11 is disposed at a specified height below the support plate 20 such that it emits light upward. An infrared signal from the transmission LED 11 is transmitted toward the running body 30 running on the support plate 20 over a specified angle. A single transmission LED may be disposed in the center portion but, in order to more securely transmit the signal, it is better to provide a plurality of transmission LEDs so as to cover the respective divided areas of the support plate 20.

The transmission LEDs 11 are connected with the LED driver 15 which controllably drives the transmission LEDs 11 in accordance with a turn-on command signal from the controller 13 so that the transmission LEDs 11 transmit specified infrared pulse signals. The turn-on command signal is used to turn on the respective transmission LEDs 11. In the game machine in which a plurality of transmission LEDs 11 are provided, the LED driver 15 controllably drives the transmission LEDs 11 such that the transmission LEDs 11 connected in parallel with one another transmit synchronized optical pulse signals. Thus, even if the areas covered by the transmission LEDs 11 partly overlap, no interference occurs, thereby preventing an erroneous operation.

Next, the operation of the bicycle race game machine according to this embodiment is described.

Upon application of power to the game machine, the entire system is first initialized to reset values of a variety of variables. Further, a communication port of the controller 13 is initialized.

Subsequently, the controller 13 performs a processing to start one race. Specifically, a game start screen and an odds display screen are displayed on the monitor 4 of each operation unit 3. At this stage, it is waited on stand-by until the respective players make bets by means of the operation units 5, and then the respective model bicycles 80 are moved to a start line drawn in a specified position of the track 2. Further, the position detection by the position detector 14 is started to detect initial positions of the model bicycles 80 located along the start line (precisely speaking, the initial positions of the running bodies 30).

A race start processing includes determination of a scenario of this race, i.e. at which speeds the respective model bicycles 80 run and in which order the respective model bicycles 80 finish the goal (hereafter, race development). If the race development is same for every race, then the players lose their interest in the bicycle game. Accordingly, a plurality of race developments are stored in the ROM of the controller 13, and any one of these developments is selected every time the race start processing is performed.

Particularly, in the game machine according to this embodiment, the running body 30 for driving the model bicycle 80 runs along any desired course on the support plate 20 in accordance with a run control signal from the controller 13. Accordingly, the race development data includes a course data concerning as to which course each running body 30 runs (i.e. which course on the track 2 each model bicycle 80 runs). If the respective model bicycles 80 runs the same nonoverlapping courses every time, the course data may be provided separately from the race development data. Alternatively, if there is no predetermined race development and a run control for each model bicycle 80 is executed at specified intervals based on the position of the model bicycle 80, an operation of determining the race development can be omitted.

Thereafter, based on the determined race development and the detected initial positions of the respective model bicycles 80, target positions of the respective model bicycles 80 immediately after the start of the race is determined by the controller 13. For example, the target position is a position each model bicycle 80 reaches 1 sec. after the start.

Upon determination of the target positions, differences between the initial positions of the respective model bicycles 80 and the target positions thereof are calculated, and command values are output to the respective running bodies 30 in accordance with the calculated differences. The command values are converted by the infrared LED driver 15 into signals used to drive the transmission LED 11. Thus, the infrared optical pulse signals corresponding to the command values are transmitted from the transmission LED 11 to the respective running bodies 30.

The speed and direction of each running body 30 are instructed in accordance with only a target speed data. More specifically, the speed instruction is given to the wheels on one specific side, e.g. to the motors **46*a*, 46*b* for driving the drive wheels 33*a*, 33*b*, and the direction instruction is given in the form of a speed difference between the motor 46*a* and the motor 46*b*. The direction of the running body 30 may be similarly controlled by independently instructing the rotating speed to the respective motors 46*a*, 46*b***.

When the infrared ray receiving unit 51 of the running body 30 receives the infrared optical pulse signal from the transmission LED 11, the microcomputer 47 analyzes this signal; calculates the command value: and sends a signal to the motors **46*a*, 46*b* so as to drive the motors 46*a*, 46*b* at specified rotating speeds corresponding to the command signal. The motors 46*a*, 46*b* rotate in accordance with the signal from the microcomputer 47, and thereby the drive wheels 33*a*, 33*b* rotates at specified rotating speeds. As a result, the running body 30** starts running in a specified direction at a specified speed corresponding to the command value.

As the running body 30 runs, the intermediate vehicle 60 and the model bicycle 80 start running in the same direction and at the same speed as the running body 30 due to the magnetic attraction of the permanent magnets 44, 63 and due to magnetic attraction of the permanent magnets 76, 94, respectively.

When the model bicycle 80 starts running, the rear wheel 83 is rolled along the running plate 22. Thereby, the rolling force of the rear wheel 83 is transmitted to the crank pulley 85 via the rubber belt 86. When the crank pulley 85 is rotated, the leg units 89 are expanded and contracted. The right and left pins 99 move alternately upward and downward to rotate the rotary cylinder 98 about the shaft member 101, thereby moving the connecting rod 100 left and right. Consequently, the upper body unit 91 is swung.

In this way, the model bicycle 80 as a whole realizes an imitated motion of a bicycle racer riding a bicycle with the combination of the motion of the leg units 89, the rotation of the crank pulley 85 and crank pedal 87, and the rolling of the rear wheel 83. Further, the swinging motion of the upper body unit 91 realizes the imitated motion of an actual bicycle racer swinging his upper body for higher speed.

When the respective model bicycles 80 start running to start a race, the controller 13 receives data representative of current positions of the respective running bodies 30 which are detected by the position detector 14 at specified intervals (e.g. every several tens of msec.), and confirms the current positions of the running bodies 30. When the running bodies 30 reach the target positions, next target positions are calculated. A command value is calculated in accordance with the target position, and an infrared optical pulse signal is transmitted to the running bodies 30 via the infrared LED driver 15 and the transmission LED 11.

Upon receipt of the command value represented by the infrared pulse signal from the transmission LED 11, the microcomputer 47 of the running body 30 drives the motors 46*a*, 46*b* at the specified rotating speed in accordance with the command value as described above. As a result, the running body 30 (or the model bicycle 80) runs at the specified speed in the specified direction. The running of each running body 80 is controlled in accordance with the race development determined by repeating the above operation, and the race is performed.

During the race, the rollers 72 and the casters 74, 75 of the intermediate vehicle 60 constantly roll along the lower surface of the running plate 22 independently of the distance change between the intermediate support plate 21 and the running plate 22. Accordingly, the permanent magnet 76 provided in the upper portion of the intermediate vehicle 60 is also constantly spaced part from the lower surface of the running plate 22 by the very small distance. Thus, regardless of in which position of the track 2 the model bicycle 80 is, the model bicycle 80 is magnetically connected with the intermediate vehicle 60 due to the magnetic attraction, and runs as the intermediate vehicle 60 runs.

The game ends after all the model bicycles 80 run the track 2 around a predetermined number of times and finish the goal line drawn on the track 2. Upon completion of the game, the controller 13 stops sending the command values. Thereafter, the post-game processing is performed. Specifically, the running bodies which won the prizes are determined and displayed, and coins are paid to the player(s) who made a successful bet.

The race is performed as described above. In the model bicycle of this embodiment, the model bicycle 80 as a whole is supported by the rear wheel 83 and the pair of support rollers 93. Further, the rolling force of the rear wheel 83 is used as the driving force of the model bicycle 80 (movement of the leg units 89 and swinging motion of the upper body unit 91). Accordingly, compared to the case where the model bicycle 80 runs with the front wheel 82 brought into contact with the running plate 22, the frictional resistance between the front wheel 82 and the running plate 22 can be reduced. Thereby, the model bicycle 80 can run with a small attraction force without impairing the function of imitatingly reproducing the motion of a bicycle in a bicycle race course, and can smoothly change its running direction.

The swinging motion of the upper body unit 91 resembles the racing motion of an actual bicycle racer riding a bicycle to a great extent. Accordingly, the use of the model bicycle of this embodiment for a bicycle race game machine realizes a thrilling and exciting game, thereby making the players feel as if they were really at the bicycle race course.

The detail of the game machine according to the invention is not limited to the foregoing embodiment, but may be modified in various manners.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A running model comprising:

a frame member having a front end and a rear end;

a front wheel rotatably supported at the front end of the frame;

a rear wheel rotatably supported at the rear end of the frame;

a dummy object mounted on the frame, the dummy object including a motion portion operatively connected with a particular one of the front and rear wheels; and a support wheel rotatably supported on the frame, a lowest peripheral point of the support wheel being below a line connecting respective lowest peripheral points of the front and rear wheels, the support wheel being disposed between the front and rear wheels and the support wheel being smaller in diameter than the front and rear wheels.

2. A running model according to claim 1, wherein:

the support wheel is disposed between the front and rear wheels; and the center of gravity of the running model is between the support wheel and the particular wheel.

3. A running model comprising;

a frame member having a front end and a rear end;

a front wheel rotatably supported at the front end of the frame;

a rear wheel rotatably supported at the rear end of the frame;

a dummy object mounted on the frame, the dummy object including a motion portion operatively connected with a particular one of the front and rear wheels;

a support wheel rotatably supported on the frame, a lowest peripheral point of the support wheel being below a line connecting respective lowest peripheral points of the front and rear wheels;

a crank mechanism operatively connected with the particular wheel to be actuated by a rotation of the particular wheel;

a rotary member supported by the frame and rotatable about an axis extending generally in a forward and rearward direction, the rotary member being operatively connected with the crank mechanism; and an appearance part of the dummy object being fixedly connected with the rotary member;

whereby the appearance part of the dummy object moves in a sideways direction in accordance with the rotation of the particular wheel.

4. A running model according to claim 3, wherein the crank mechanism includes:

a rotary shaft rotatably supported by the frame and extending in a sideways direction and having a right end and a left end;

a right link member having an end operatively connected with a right side of the rotary member and another end fixedly connected with the right end of the rotary shaft; and a left link member having an end operatively connected with a left side of the rotary member and another end fixedly connected with the left end of the rotary shaft, the another end connection position of the left link member being shifted from that of the right link member 180 degree with respect to the rotation of the rotary shaft.

5. A running model comprising:

a frame member having a front end and a rear end;

a front wheel rotatably supported at the front end of the frame;

a rear wheel rotatably supported at the rear end of the frame;

a dummy object mounted on the frame, the dummy object including a motion portion operatively connected with a particular one of the front and rear wheels;

a support wheel rotatably supported on the frame, a lowest peripheral point of the support wheel being below a line connecting respective lowest peripheral points of the front and rear wheels;

a rotary shaft rotatably supported by the frame and extending in a sideways direction and having a right end and a left end;

a right link member having an end operatively connected with a right side of the rotary member and another end fixedly connected with the right end of the rotary shaft; and a left link member having an end operatively connected with a left side of the rotary member and another end fixedly connected with the left end of the rotary shaft, the other end connection position of the left link member being shifted from that of the right link member 180 degrees with respect to the rotation of the rotary shaft.

6. A running model comprising:

a frame means having a front end and a rear end;

a front wheel rotatably supported at the front end of the frame means;

a rear wheel rotatably supported at the rear end of the frame means;

a dummy object mounted on the frame means, the dummy object including a motion portion operatively connected with a particular one of the front and rear wheels;

the dummy object having a fixed dummy part fixed to the frame means and a moveable dummy part moveable relative to said fixed dummy part; and operable means operably connected between said motion portion and said moveable dummy part for effecting sideways movement of said moveable dummy part relative to said fixed dummy part in accordance with the rotation of the particular wheel.

7. A running model according to claim 6 wherein said operable means is further operable to also move the dummy part in a forward and rearward direction relative to said fixed dummy part in accordance with the rotation of the particular wheel, said forward and rearward movement along with said sideways movement being effected simultaneously.

8. A running model according to claim 6 wherein said operable means comprises a rotary element rotatable about an inclined longitudinal axis which is inclined relative to horizontal, said rotary element mounting said moveable dummy part such that said moveable dummy part rotates about said inclined longitudinal axis.

9. A running model according to claim 6 wherein said rotary element is an elongated cylinder, said fixed dummy part having a rod received in said cylinder to rotatably support said cylinder.

10. A running model according to claim 9 wherein said cylinder has cam follower pins, said operable means including reciprocable link members having grooves receiving said cam follower pins to effect back and forth rotary movement of said cylinder.

11. A running model according to claim 8 wherein said rotary element is an elongated cylinder, said operable means further comprises mounting means mounting said moveable dummy part on said cylinder, said mounting means comprising pin means on said cylinder disposed in receiving openings on said moveable dummy part.

12. A running model according to claim 9 wherein said pin means have a pin axis which extends radially from said cylinder, said pin axis being perpendicular to said inclined longitudinal axis, said pin means being loosely received in said openings.

* * * * *